US006866258B1

(12) United States Patent
Golicz

(10) Patent No.: US 6,866,258 B1
(45) Date of Patent: Mar. 15, 2005

(54) FEEDER-SINGULATOR FOR ARTICLES HAVING INTERMIXED THICKNESS AND SHAPE

(76) Inventor: Roman M. Golicz, 26 Indian Dr., Clinton, CT (US) 06413

( * ) Notice: Subject to any disclaimer, the term of this patent is extended or adjusted under 35 U.S.C. 154(b) by 0 days.

(21) Appl. No.: 10/376,148

(22) Filed: Feb. 28, 2003

Related U.S. Application Data

(60) Provisional application No. 60/360,919, filed on Feb. 28, 2002.

(51) Int. Cl.[7] ..... B65H 3/04

(52) U.S. Cl. ..... 271/35; 271/34; 271/2; 271/275; 271/10.06; 271/121; 271/124; 414/797.6

(58) Field of Search ..... 271/2, 34, 35, 271/275, 198, 10.06, 121, 124; 414/797.6

(56) References Cited

U.S. PATENT DOCUMENTS 4,114,870 A * 9/1978 Di Blasio ..... 271/35
4,978,114 A * 12/1990 Holbrook ..... 271/35
5,007,627 A * 4/1991 Giannetti et al. ..... 271/35
5,033,729 A * 7/1991 Struthers ..... 271/10.06
5,062,600 A * 11/1991 Holbrook et al. ..... 271/35
5,074,540 A * 12/1991 Belec et al. ..... 271/34
5,257,777 A * 11/1993 Kalika et al. ..... 271/35
5,456,457 A * 10/1995 Kerstein et al. ..... 271/10.07
6,135,441 A * 10/2000 Belec et al. ..... 271/35
6,276,679 B1 * 8/2001 Joyce et al. ..... 271/122
6,328,300 B1 * 12/2001 Stefan et al. ..... 271/2

* cited by examiner

*Primary Examiner*—Donald P. Walsh
*Assistant Examiner*—Matthew J. Kohner
(74) *Attorney, Agent, or Firm*—C. Nessler

(57) ABSTRACT

Two belt type singulators are used in apparatus which feeds and singulates stacked articles which have varying thickness and shape. The singulators form tandem, spaced apart singulator nips with a transport belt. Each singulator belt has a downwardly sloped underside and moves incrementally around its rollers over time, overcoming certain applied resistive forces. The singulator belt has intermittent contact with the transport belt, when articles are being processed, and there is a resultant scuffing of belts which helps remove debris. Preferably, on off the forces which resists singulator belt motion is created by having a singulator pair with upper rollers, which are rotationally coupled but which have different diameters. The upper ends of the singulator belts project into the hopper which holds the stack and aid in the feeding of articles toward the singulating nips.

16 Claims, 4 Drawing Sheets

FEEDER-SINGULATOR FOR ARTICLES HAVING INTERMIXED THICKNESS AND SHAPE

This application claims benefit of provisional patent application Ser. No. 60/360,919, filed Feb. 28, 2002.

TECHNICAL FIELD

The present invention relates to document handling, in particular to feeding of envelopes and other flat articles, of intermixed size and thickness, to a slitting device or other document processor.

BACKGROUND

Organizations which receive a lot of mail have automated and semi-automated labor-saving devices to handle and open the mail, by orienting and slitting the envelopes and extracting the contents for processing. There are various types of commercial machines that are well suited to handling envelopes that are of nearly the same size, such as for instance standard envelopes bearing payments for a utility company. In essence, such machines must first singulate envelopes, that is, select and feed one envelope after another from a stack, so they can be slit or otherwise processed one by one.

However, when the envelopes within a lot being processed vary in shape and especially thickness from piece to piece, then many prior art machines are less effective at singulating. Thick envelopes will jam at the singulator nip if the machine is configured for thin envelopes. Mis-feeding, of multiples of thinner envelopes, occurs when the machine is configured for the thicker envelopes. Thicker envelopes tend to have somewhat variable and indefinite wedge shape edges. Larger and thicker flat envelopes present special problems because they resist aligning against a downstream hopper surface in orderly fashion, and may even be shingled in the direction opposite of the direction of feeding. Whether or not thickness varies greatly, intermixed large and small shape envelopes present handling problems.

Another problem that attends many commercial envelope handling machines is the tendency for roller or belt surfaces to become fouled by debris picked up from the surfaces of the envelopes or other articles. When that occurs, frictional engagement with the articles diminishes, and any singulating or feeding action becomes impaired. To restore functionality, the machine has to be stopped so the rollers or belts can be cleaned or replaced.

The weight of a stack can create high inter-envelope friction among the bottommost envelopes, impeding singulating. On the other hand, when there are hardly any envelopes in the hopper, poor feeding and singulating can take place because of low friction in the system. Thus, there tends to be a need for continuing operator intervention, to correct deviations, or to maintain the hopper stack within some maximum and minimum range. Still another problem with prior art machines is that when envelopes, particularly ones which vary in size and shape, are put in a hopper for feeding to a singulator or document handling device, there is a tendency for them to "hang up", or to lightly wedge in the hopper, and to cease dropping down as each bottommost envelope is fed away. A machine will then cease processing of items until the operator intervenes to aid the downward feeding manually.

Thus, even though there has been a lot of past development, and there have been many designs of machines for handling envelopes and other flat objects, there continues to be a need for improvements in the ways that have been mentioned.

SUMMARY

An object of the invention is to provide apparatus and method for feeding and singulating envelopes and other flat articles, which vary in shape and especially thickness within a lot being processed, as well as when there is reverse shingling. Another object is to processing of flat articles while minimizing the tendency for debris to disruptively accumulate on feeding belts; and, to extend the life of feeder or singulator belts. A still further object is to have consistent singulating performance, whether a feed hopper is full or virtually empty.

In accord with the invention, apparatus comprises at least two substantially similar singulator assemblies which are spaced apart transversely above the article flow path, and means for moving flat articles, such as a transport belt, to move articles from a stack to the nip formed by the singulators. Each singulator is comprised of an endless elastomer belt running around rollers and a body which is pivotably urged downwardly, toward the means for moving. The underside portion of the singulator belt slopes downwardly toward the means for moving, preferably at an angle of 30–45 degrees to the horizontal. The singulating nip is formed between the singulator assembly and the transport belt or other moving means. The elevation of the sloped belt portion is sufficient to enable a plurality of articles from the stack being processed to contact the belt, to become shingled, and to have their leading edges moved in a desirable way toward the singulator nip. Preferably there are two transport belts, one corresponding with each singulator assembly. Alternately, a single transport belt may be used. More than two singulators may be used.

During operation of the apparatus, the singulator belt intermittently touches the transport belt or other moving means, in the moment when articles are not present in the singulator nip. There are means for resisting singulator belt motion, and the belt is for the most time stationary. But the belt incrementally moves around the singulator over time, with repetitive passage of articles through the singulating nip, whenever the threshold resistance to motion which is designed into the singulator is exceeded.

Preferably, the pair of singulators is connected by a rotatable shaft, to which the respective upper rollers are affixed. One of the singulators has a smaller diameter upper roller than the other, and they are otherwise substantially the same. The effect of the different diameter rollers is to create a "fight" between the singulators, and thus the desired resistance to motion. Less preferably, brakes and other means may be used. Additional resistance to singulator belt motion is created by articles pressing against the underside of the singulator belt, due to the drag effect of underlying articles being drawn toward and through the singulator nip. Thus, when both singulator belts touch their respective identically moving transport belts, the desired scuffing is created, and there is a slight incremental movement of the singulator belt around its rollers. Continuous contact of the singulator belt(s) with the transport belts causes the singulator belt to move continuously, inasmuch as the resistance breakaway threshold is exceeded.

Preferably, the articles such as envelopes are contained in a hopper; and the upper end of the each singulator belt protrudes into the downstream wall of the hopper. The protruding belts help alleviate the weight of a heavy stack of envelopes on underlying articles. When envelopes become hung up in the hopper, the absence of envelopes approaching the sloped underside of the singulator causes the singulator belts to contact the transport belt and thus be moved. The belt motion at the upper end of the singulator desirable tends to push the leading edges of the envelopes downwardly, to alleviate the jam.

Preferably, the apparatus includes dual takeaway assemblies, downstream of the singulator assemblies, for carrying away articles, which exit the singulator nips. Each takeaway assembly includes a roller mounted on the shaft which moves the transport belts.

The aforementioned functioning of the apparatus entails a unique method of feeding and singulating articles. The apparatus processes at high speed intermixed articles having varying thickness and shape, especially width, and thicker envelopes that have tapered edges. The foregoing and other objects, features and advantages of the invention will become more apparent from the following description of preferred embodiments and accompanying drawings.

DESCRIPTION

While the invention is described in terms of handling flat envelopes for slitting, the invention will be suited for feeding other flat articles for other purposes. The apparatus has various mechanical elements, including such as rollers, conveyors and belts, which are similar in construction and material to those in apparatuses described in U.S. Pat. No. 5,971,389 "Feeder for Flat Articles of Varying Thickness" and U.S. patent application Ser. No. 08/962,077 "Sheet Feeding Apparatus", filed Sep. 14, 1998, for which the applicant here is inventor or co-inventor. The disclosures thereof are hereby incorporated by reference, as is the disclosure of provisional patent application Ser. No. 60/360,919, filed Feb. 28, 2002 by applicant. The apparatus described below is mostly constructed of common aluminum structural alloy. Other metals and structural plastics may be used, within ordinary engineering skill.

Figure 1:
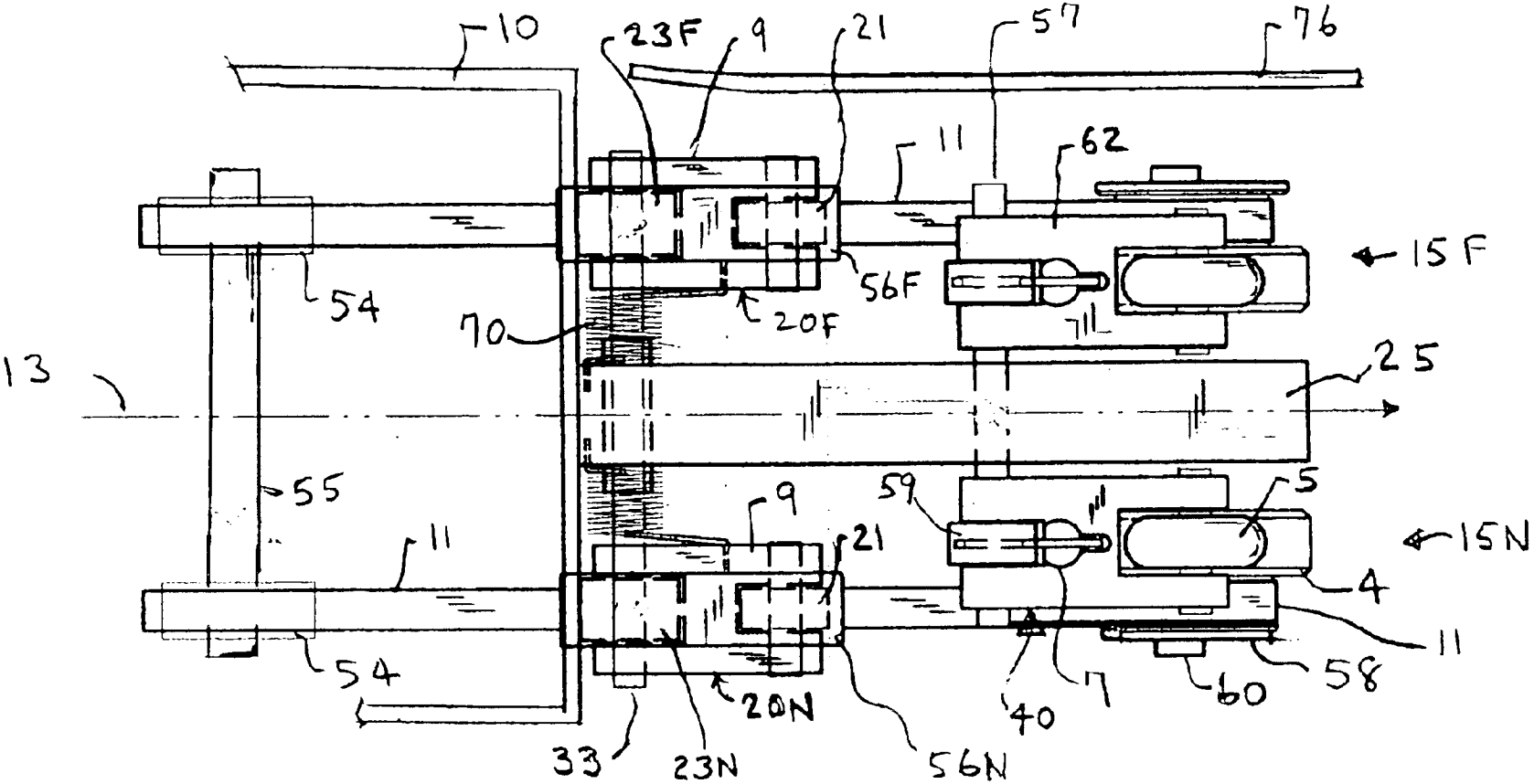
FIG. 1 is a top view of apparatus for feeding and singulating envelopes which has various assembly pairs positioned on either side of a support strut and the flow path.
Figure 2:
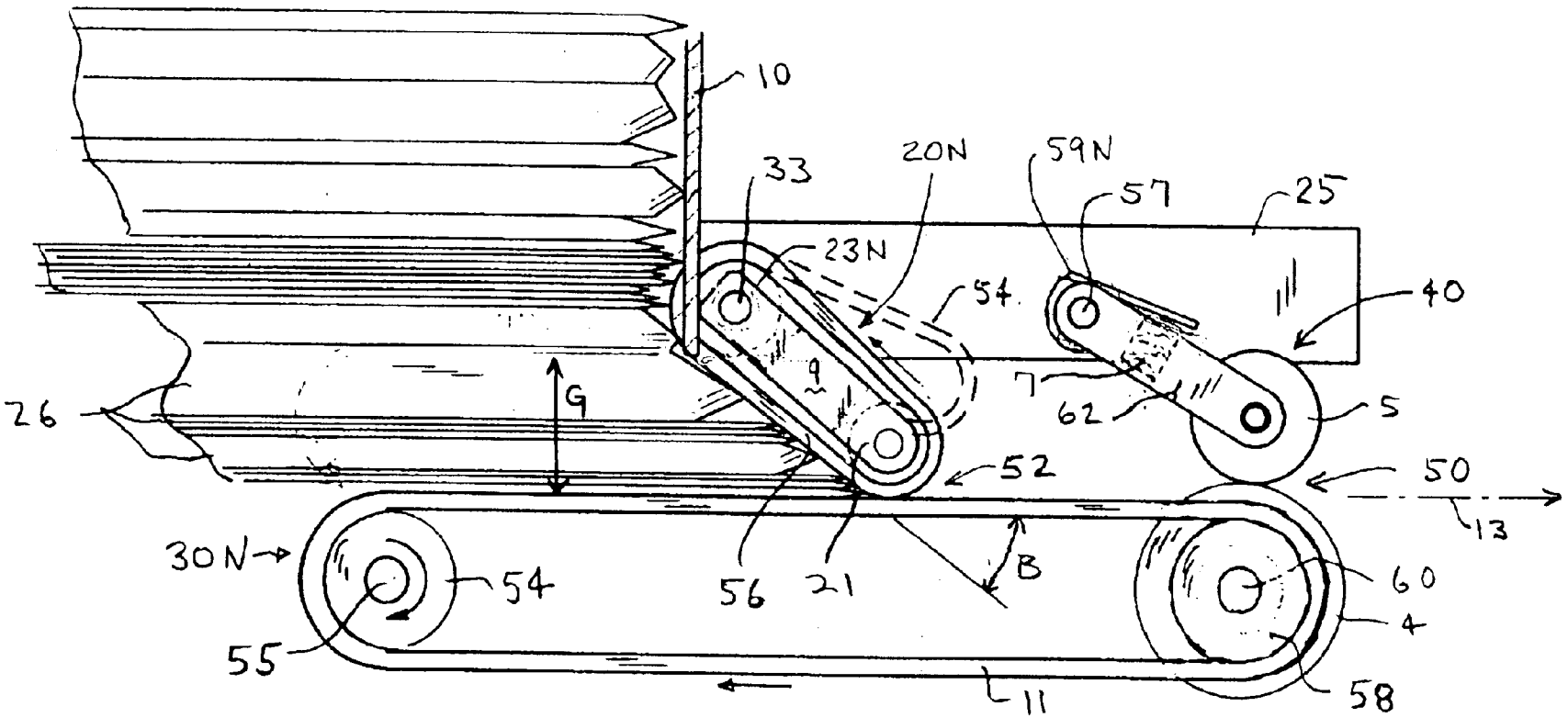
FIG. 2 is a side view of the apparatus of FIG. 1, showing a stack of envelopes being fed from the hopper.

FIG. 1 is a top view and FIG. 2 is a side elevation view of the apparatus. Envelopes are drawn from a stack contained in a hopper 10 and are moved downstream along the envelope flow path 13. The envelopes that are drawn from the hopper pass first through a singulator nip 52 and then through a takeaway nip 50. The envelope handling is carried out by two nearly identical assemblies, 15N and 15F, spaced apart transversely across the flow path. In the FIGS. 1 and 2 embodiment, they are on either side of the strut 25. The assemblies 15F and 15N are substantially identical, but have different size upstream rollers, 23N and 23F, described in more detail below. In the Figures and this description, the parts of paired assemblies have identical numbers, but some are called out in the drawing by a suffix, N or F, according to which side of the flow path the particular item lies, to aid in comprehension of the drawings. Other suffixes are used for the corresponding parts of alternative embodiments. An assembly 15 will now be described, as exemplary of the two assemblies 15F and 15N.

Assembly 15 is comprised of a three assemblies 20, 30, and 40. Transport assembly 30 moves the envelopes along the flow path from the hopper and through the singulator nip. Singulator assembly 20 is mounted above the transport assembly, with which it cooperates to form nip 52, which is just downstream of the downstream end of hopper 10. Takeaway assembly 40 is mounted downstream of the singulator assembly. The subassemblies 20 and 40 are supported off main strut 25 which extends downstream from hopper 10, above and parallel to the flow path 13. The hopper and main strut are mounted on an unshown base, as is the transport assembly.

Transport assembly 30 is comprised of elastomer belt 11 which runs over opposing end transporter rollers 54, 58. Roller 58 is fixedly mounted on and driven by shaft 60 which is driven by an unshown motor. Roller 54 is an idler running on shaft 55.

Takeaway assembly 40 is comprised of roller 5 which presses against roller 4. Roller 4 is on shaft 60, next to transport belt 11 where it runs over transport roller 58. Rollers 4 and 58 are both fixedly attached to and rotated by driven shaft 60. Roller 4 forms a take away nip 50 with roller 5, which is mounted at the end of H-shape takeaway body 62. Body 62 is pivotable in the vertical plane from fixed shaft 57, which projects transversely from strut 25. Body 62 is spring biased downwardly by spring 7, which is captured in a cavity within body 62, and bears against the lever arm of collar 59, which is fixed to the shaft 57. The downward spring force applied to roller 5 is sufficient to cause frictional engagement between the envelope and roller 4, and to move the envelope downstream to the unshown slitter or other processing device, after the envelope exits the singulator nip.

Roller 4 is larger in diameter than belt 11 where it runs around roller 58. Thus, during operation the effect of rollers 4 and 5 of the takeaway assembly will be to draw envelopes from the singulator nip 52 at a speed faster than the speed of the transport belt 11, which is nominally the speed with which envelopes are moved through the singulator nip. Roller 5 is made of soft elastomer material such as polyurethane or rubber having 70–80 Shore Durometer hardness, while the driven roller 4 is made of stainless steel or chromium plated carbon steel and has a polished surface.

Singulator assembly 20 comprises belt 56 which runs endlessly around an upper roller 23N/23F and lower idler roller 21, at opposing ends of H-shape body 9. The upper end of body 9 is pivotably mounted on shaft 33. Shaft 33 is journaled in, and freely rotatable in, a bearing running transversely through strut 25. The upper rollers 23N and 23F are fixed to the common shaft 33. The underside of belt 56 runs downwardly at an incline. The lower end of belt 56, where it runs around roller 21, is adapted to contact the transport assembly belt 11, and create nip 52. Gravity and torsion spring 70 urge the body 9 to pivot downwardly, so it contacts transport belt 11 when there is no article in the nip. The phantom 54 of the singulator assembly in FIG. 2 shows how assembly 20 pivots upwardly against the spring bias when an envelope 26 passes through the nip 52.

The elevation of the shaft 33 relative to the transport belt surface and the length of body 9 are selected so that the bottom surface of the belt 56 runs at an angle B to the horizontal of about 30–45 degrees, preferably about 37 degrees. When singulator belt 56 contacts moving belt 11 in the absence of any envelope in the singulator nip 52, the belt 56 is moved around its rollers.

As mentioned, singulator assembly 20N differs from the opposing side assembly 20F with respect to the rollers 23. That difference is intended to create "fight" between the motions of the opposing side singulator belts 56F, 56N, when the belts engage envelopes or rest on their respective transport belts 11. The "fight" creates resistance to motion of the belts around their respective rollers. In the embodiment shown in FIGS. 1 and 2, roller 23F is slightly but significantly smaller in diameter than roller 23N. For instance, the ratio between the diameter of roller 23F to that of 23N is 25/26. The effect is to make the breakaway threshold, or the point at which a driving force on the belt overcomes the resistance of the belt to motion, a bit lesser for assembly 20F than for assembly 20N. Of course, when the force applied to either belt exceeds the breakaway threshold both belts will move.

Since the belts are identical, the tension in the belt 56F of singulator assembly 20F will be less than the tension in belt 56N of singulator assembly 20N, according to the difference in lengths around the rollers of the two singulators. And also, therefore, the smaller diameter of roller 23F makes the belt of singulator 20F want to rotate the roller 23F faster than does the belt of singulator 20N want to rotate the roller 23N. But, both rollers 23 are fixed to the same shaft 33, and thus the "fight" is created. The result of the fight is resistance to movement by both belts when driving force is simultaneously applied to both belts, as when each belt 56 contacts an envelope moving through nip 52 or same-speed transport belts. Other forces, described below, add to effect of the different diameter rollers in making the belts resist motion. When stationary belts 56 contact moving belts 11, there is a resultant desirable scuffing action, which tends to clean debris the belts.

The result of the fight and lower tension and lower resistance to motion for belt 56F of singulator 20F, compared to belt 56N, is that belt 56F will slip in creeping fashion around the roller 23F, when the forces acting on belt 56*s* are sufficient to move the belts 56. So, over time, there is small, but cumulatively significant, difference in relative movement between the belts 56F and 56N in context that both belts move. Over time, both belts 56 move around their respective rollers in the direction indicated by an arrow in FIG. 2. New portions of the belts will continuously be presented at the nip, as described further below. Thus, wear on the belts 56 due to scuffing action at the nip is distributed along the surface of the belts, as is accumulation of debris which scuffing does not remove. Relatively infrequent operator attention and maintenance is required.

The breakaway threshold, where resistance to motion of the singulator belts is overcome, is predetermined and can be changed by design. For instance in the preferred embodiment being described, tension is lowered in the less tensioned and first-to-slip belt, i.e. belt 56F. That may be accomplished by changing either diameter of roller 23F, or the center-to-center distance of the rollers, or less practically, the length of the belt.

The operation of the apparatus is as follows. Referring particularly to FIG. 2, a first envelope 26, which lies on the surface of belt 11, enters singulator nip 52. As the envelope passes through nip 52, the leading edge enters the takeaway nip 50. But until the transport belt causes the trailing edge to exit nip 52, the takeaway roller 4 slips against the underside of the envelope. Once the envelope exits the singulator nip 52, it is accelerated by the takeaway nip, to be ejected from the machine. When a first envelope exits nip 52, the next or second envelope, which has been pressing against the underside of the belt 56, has to accelerate into the nip. During that process, for a brief moment nothing is in the nip, and belt 56 contacts belt 11, to achieve the desirable scuffing action, as belt 11 seeks to accelerate belt 56.

The breakaway threshold for belt motion is by design set so that when there is continuous contact of belt 56 with belt 11, belt 56 will be driven around its rollers. When processing envelopes continuously, the area and time of contact between the belts 56 and 11 is very small. However, when processing tens of thou sands of envelopes per hour, the cumulative effect of such contact, in combination with the effect of dropping down of envelopes, which are pressing against the sloped upstream underside of the belt 56, is that there will be a continuous creeping motion of the belt 56 around the rollers. This is further explained below.

When a first and bottommost envelope enters into and is passing through nip 52, the singulator body 9 rotates upwardly toward phantom position 54. As the first envelope passes through the nip, overlying envelopes are frictionally dragged downstream toward the nip. However, they are reared from passing through the nip because of contact with the sloped underside of the then-stationary belt 56. Since the overlying envelopes are continuously dragged downstream, with removal of successive bottommost envelopes, they become shingled and press against the underside of belt 56. A feature of the sloped underside of the belt 56 is that the leading edges of common envelopes, being tapered or wedge shaped, are deflected downwardly toward the nip, and the result is more assured singulating at the nip.

Once a first envelope has exited the singulator nip, the stacked and shingled overlying envelopes which are pressing against the underside of the belt 56 drop downwardly. When pressing against the belt prior to dropping, the envelopes exert a retarding or resistive force against belt motion. When the envelopes drop downwardly toward the transport belt, the pressing force is momentarily lessened. That aids in the incremental motion of the belt, in the direction which is induced by the scuffing. Motion of belt 56 ceases when the first envelope is passing through the nip, and the stationary belt of course carries out the singulating function by hindering the second envelope from entering the nip. The operation continues until the supply of envelopes in the hopper is exhausted.

The apparatus can handle stacks where there is "reverse shingling" of some or all of the envelopes. Suppose one envelope is in the stack "reverse shingled". That means the downstream end of an envelope is more upstream than the downstream end of the envelope that overlies it. Suppose that the shingling effect caused by transport belt induced drag is insufficient to overcome the degree of reverse shingle. Even so, the apparatus will function properly, inasmuch as, when the reversed shingle envelope drops down onto the transport belt, it will be caused to advance toward the nip.

The singulator belts are flat and preferably made of molded natural rubber compound having a hardness in the range 60–80 Shore Durometer. The transport belts are preferably a flat laminated timing belt having a polyurethane surface of 50–80 Durometer.

Figure 6:
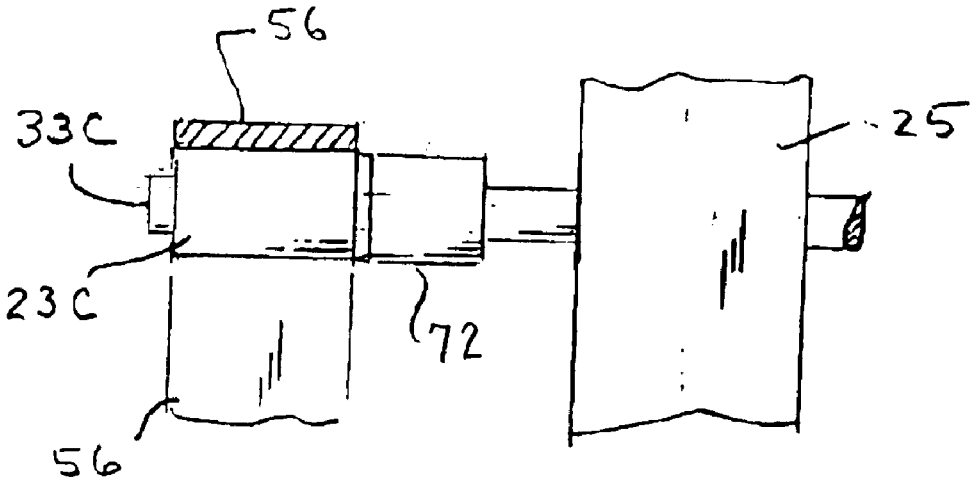
FIG. 6 shows a cut-away portion of the upper end of a singulator assembly, indicating how a brake is used to retard motion of the upper roller and belt.

The different diameter singulator rollers may be connected to one another by more complicated means than the simple shaft 33, for instance by a gear or pulley train. In the generality of the invention, means other than different diameter rollers can be employed for creating the resistance to motion in the opposing side singulator belts 23. For instance, a brake may be applied to one or two of the rollers 23 in the apparatus of FIG. 1. For another instance, the rollers 23 may be independently mounted and controlled. See FIG. 6, where upper singulator roller 23C rotates on a fixed shaft 33C which extends transversely from strut 25. Brake 72 applies adjustable frictional force to the roller to retard rotation. The body 9 is omitted from the Figure for clarity. The opposing side singulator will be similarly constructed. Brakes are less desired because they require more parts, adjustment, and even sensing and control equipment, and concentrated heat is generated. Other means for providing the desired threshold resistance may be employed.

The downstream wall of the hopper 10 is spaced apart from the top surface of transport belt 11 by a distance G. See FIG. 2. The dimension G is made small enough so that stacked envelopes which are frictionally drawn downstream by the transport belt will contact only the downward sloped portion of belt 56, on the underside of singulator body 9. The distance G is made large compared to thickness of envelopes, sufficient to enable a multiplicity of envelopes to contact the sloped belt portion. For instance, G might be 5 cm, where envelopes may vary from 0.1 to 0.6 cm in thickness. In operation, the sloped portion of belt 56 is of such length that during use, it will be contacted by a multiplicity of envelopes at any given time.

Following common practice, the hopper sidewalls are inclined with respect to a vertical centerline plane, so that envelopes in the stack will shift toward one sidewall of the hopper and become aligned in the transverse direction. Thus, when the envelopes are deposited on the transport belt, one edge will be at a known location with respect to the flow path; and envelopes can be appropriately delivered to a slitting device downstream from the takeaway section.

In one embodiment and use, all the envelopes are of substantially similar shape, but of varying thickness. In such case, a pair of singulator assemblies will preferably be located on either side of the centerline of the flow path and of the articles being processed. In another embodiment and use, the envelopes have different shapes, most importantly different widths. They may or may not be of varying thickness. In such case the pair of singulator assemblies will be located so both engage the smaller width articles, which will be guided by a fence 76, shown in FIG. 1, running along one side of the apparatus. The fence may be laterally adjustable for aligning envelopes with a slitter. Large width articles intermixed with the small articles will also be guided by the fence. There is no fence on the opposite side of the device/flow path. Thus, there is no constraint on handling the large article. While the centerline of large article will be offset from the centerline of the singulator pair, good functioning is not impaired. Thus, the apparatus and method is quite adaptable to processing different shape and thickness envelopes.

The upper end of each belt 56, where it rotates around roller 23, protrudes through a slot at the bottom of the downstream vertical wall of hopper 10, into the hopper interior. Thus, when the stack is large enough, the downstream ends or leading edges of envelopes, stacked within the hopper, contact the upper end of belt 56, when move downwardly under force of gravity as underlying envelopes are being removed. To move downwardly past by the upper ends of belt 56*s*, the envelopes will necessarily be thrust rearwardly a small amount. The feature is useful in several respects. First, some of the downward force due to weight of the stack is taken off the underlying envelopes. That makes it easier for those envelopes to become shingled when they enter gap space G. Second, there is a friction force on the belt 56 at roller 23, which provides resistance to belt motion, which is desired. Third, suppose envelopes are jammed within the hopper just above the belt at roller 23. As underlying envelopes are fed through the singulator, there will quickly be no envelopes pressing against the underside of the belt 56, and none entering the singulator nip. Belt 56 will thus drop into contact with the belt 11 and be continuously driven. The resultant motion of the belt 56 where it runs around roller 23 will tend to push the leading edges of the envelopes downwardly, into the gap G, alleviating the jam. To protect the belts from undue wear in the event that the hopper is emptied, micro-switch or optical sensing means with controls are used, to shut down the transport drive motor when no new envelope falls onto the transport belts after a pre-set timeout period.

Thus, to summarize, in the preferred embodiment, there are three retarding or resistive forces applied to the belt 56, namely: (1) frictional resistance to belt motion induced by the different diameters of the upper rollers 23, alternately by other means; (2) the front ends of the stacked envelopes contact and rub against the underside of belt 56; and, (3) the belt 56 running around either roller 23 protrudes into the hopper and engages envelopes in the hopper. The complexity of forces provides good function under a variety of conditions, including the state in which the hopper is heavily loaded and the state in which the envelopes in the hopper are nearly exhausted.

Still other embodiments and variations may be employed. The elements which are mounted from the fixed central strut 25 can be mounted off a different rigid structure, so the same spatial relationships are achieved. More than two singulator assemblies and associated other parts can be used in an apparatus. For example, a third singulator, mounted in parallel with the others can have resistance to motion which is the same as one of the other two, or all three singulators can be set differently. Still more singulators may be used.

Figure 3:
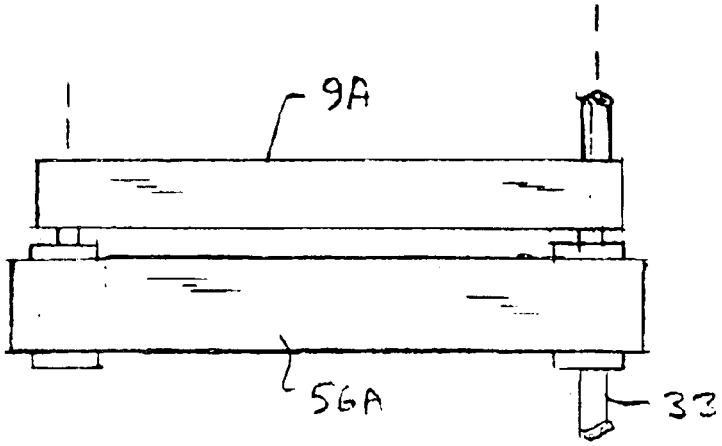
FIG. 3 is a top view of an alternative singulator body configuration.
Figure 5:
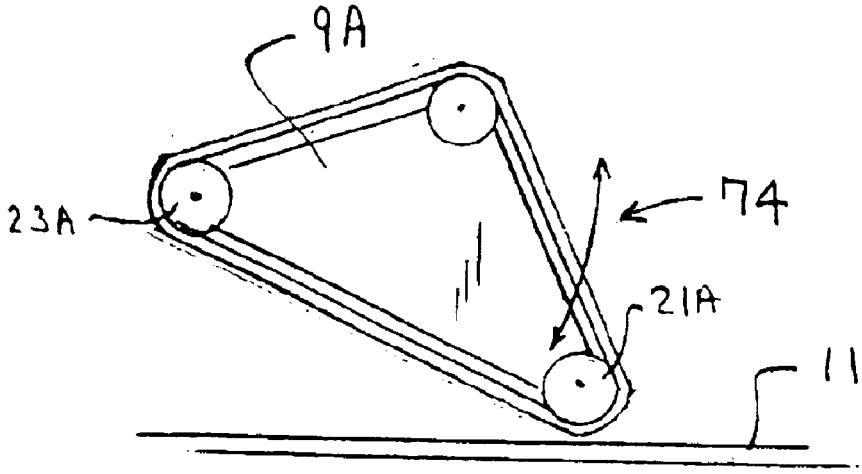
FIG. 5 is a side view of a three roller singulator assembly.

As illustrated by FIG. 3, a singulator (or takeaway) body 9A can be a simple beam, and not of H-shape, with the belt 56A running on cantilevered rollers. The singulator can have more than two rollers. As example, FIG. 5 shows a three roller singulator 74, having a triangle shape body 9A, including a nip forming roller 21A and an upper roller 23A about which the body pivots. While the springs are preferred for downwardly biasing the singulators and takeaway body, other means for accomplishing such may be employed, including other kinds of resilient means and deadweight.

Figure 4:
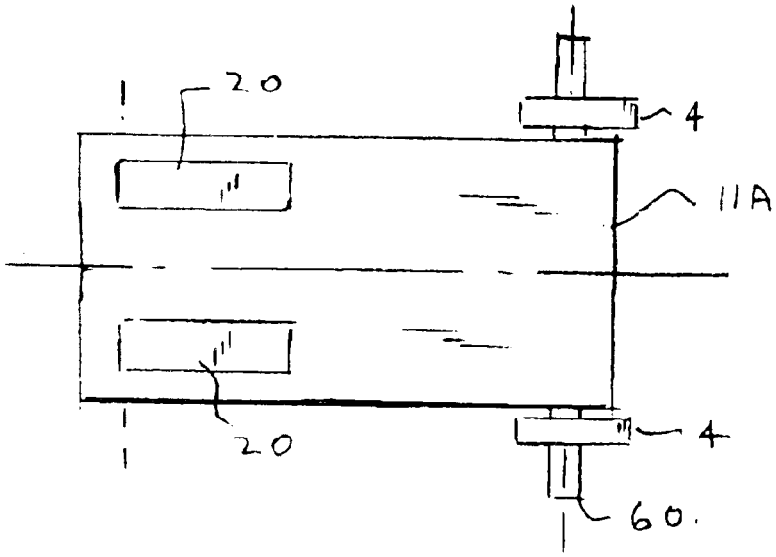
FIG. 4 is a partially schematic top view, corresponding with FIG. 1, showing an alternative embodiment which comprises a single transport belt.

As shown in FIG. 4, which is a schematic top view which corresponds with FIG. 2, there may be only a single transport belt 11A, with opposing side takeaway rollers 4 positioned outboard of the belt. In still another alternative, there is no transport belt. Instead, a series of driven rollers protrude through the surface of a platform running along the flow path, with one resilient surface roller positioned under each singulator, to form the nips. However, in such embodiment the nip roller would be much more subject to wear and fouling than would be the belt.

In the generality of the invention, the takeaway unit can be a separate spaced apart device. Alternatively, there need not be a takeaway unit, and envelopes may be just carried away and discharged by the transport belt, in the same manner as they are delivered to the singulator nip. While a hopper is preferred for depositing articles on the transport belt, other means, including manual means, may be used, although there will then not be the desirable interaction of envelopes with the upper ends of the singulator belts, and performance may be somewhat degraded.

The apparatus which has been described is not only better at handling articles of varied dimension, and at continuing operation with low operator intervention, compared to machines in the prior art, but it is capable of doing so while processing up to forty thousand envelopes per hour.

Although this invention has been shown and described with respect to a preferred embodiment, it will be understood by those skilled in this art that various changes in form and detail thereof may be made without departing from the spirit and scope of the claimed invention.

I claim:

1. In apparatus for singulating flat articles, wherein articles are transported from a stuck along an article flow path, the improvement which comprises: two spaced apart singulator assemblies of substantially identical construction, each forming a nip with one or more moving transport belts; said assemblies operating in tandem to simultaneously receive the forward edges of the articles at respective singulator nips; each singulator assembly comprising a body, rollers mounted on the body, and a singulator belt endlessly running around the rollers; and, means for resisting motion of said hefts around said rollers, the means having a breakaway threshold, so that the belt is stationary while an article is in said nip, and so that the belt moves when an article is not in the nip, due to contact and frictional engagement of the belt with a moving transport belt which engagement overcomes said breakaway threshold, to thereby produce scuffing of the singulator belt.

2. The apparatus of claim 1 wherein said means for resisting movement comprises brakes which apply frictional forces to each of the singulator assemblies.

3. The apparatus of claim 1 comprising two spaced apart transport belts, one each located under a singulator assembly.

4. The apparatus of claim 1 further comprising takeaway means located downstream of the singulator nip, for pulling articles downstream from the singulator nip at a speed faster than the transport belt moves the articles along the flow path.

5. The apparatus of claim 1 wherein the means for depositing articles comprises a hopper mounted above the transport belt.

6. The apparatus of claim 5 further comprising a hopper having a downstream end spaced apart from the transport belt a distance G, sufficient to enable a plurality of articles to simultaneously press against the downwardly sloped portion of the singulator belt of each singulator assembly.

7. The apparatus of claim 5 wherein the belt at running around the first roller of each singulator assembly projects into the interior of the hopper, so that articles stacked within the hopper and moving downwardly contact the belt.

8. In apparatus for singulating flat articles, wherein articles are transported from a stack along an article flow path, the improvement which comprises: two spaced apart singulator assemblies of substantially identical construction, each forming a nip with one or more moving transport belts; said assemblies, operating in tandem to simultaneously receive the forward edges of the articles at respective singulator nips; each assembly comprising a body, rollers mounted on the body, and a belt endlessly running around the rollers; and, means for resisting motion of said belts around said rollers, the means having a breakaway threshold, so that the belt is stationary while an article is in said nip and so that the belt moves when an article is not in the nip, wherein the means for resisting motion of said belts around the rollers provides one singulator assembly with a lower breakaway threshold relative to its assembly than that which characterizes the other singulator assembly.

9. The improved apparatus of claim 8 wherein the means for resisting motion comprises a first end roller of each assembly, wherein the first end rollers are connected to only rotate at the same velocity, said first end rollers having dissimilar diameters.

10. Apparatus for feeding and singulating a stack of flat articles, which comprises:

at least one transport belt, for moving articles downstream along the flow path;

at least two singulator assemblies, spaced apart transversely to the flow path, each assembly comprising:

a body, having a first end and second end, wherein the first end is pivotably mounted above the flow path;

a first roller mounted on said shaft, at the first end of the body;

a second roller, rotatably mounted at the second end of the body;

a singulator belt mounted on and running endlessly around the rollers, wherein a portion of the belt is sloped downwardly toward said transport belt;

means for urging the body pivotably downward toward the transport belt;

wherein, the belt portion at the second roller fonts a singulator nip with the transport belt and the belt portion contacts the transport belt when the body pivots downwardly and there is absence of an article in the nip;

means for resisting movement of each singulator belt about respective singulator rollers, the means having a breakaway threshold, so that each singulator belt is stationary while an article is in said nip, and so the belt moves, due to contact and frictional engagement with a moving transport belt which overcomes said breakaway threshold and causes scuffing of the singulator belt; and, means for depositing articles on the transport belt upstream of said singulator assemblies.

11. The apparatus of claim 10 wherein the singulator belt is sloped at an angle of 30–45 degrees to the transport belt.

12. The apparatus of claim 10, wherein the means for depositing articles comprises a hopper mounted above the transport belt, which further comprises a strut extending downstream from the hopper, wherein said shaft is mounted on the strut.

13. Apparatus for feeding and singulating a stack of flat articles, which comprises:

at least one transport belt, for moving articles downstream along the flow path;

at least two singulator assemblies, spaced apart transversely to the flow path, each assembly comprising:

a body, having a first end and second end, wherein the first end is pivotably mounted above the flow path;

a first roller mounted on a shaft, at the first end of the body;

a second roller, rotatably mounted at the second end of the body;

a singulator belt mounted on and running endlessly around the rollers, wherein a portion of the belt is sloped downwardly toward said transport belt;

means for urging the body pivotably downward toward the transport belt;

wherein, the belt portion at the second roller forms a singulator nip with the transport belt and the belt portion contacts the transport belt when the body pivots downwardly and them is absence of an article in the nip;

wherein for each singulator assembly the pivotable mounting of the body comprises a rotatable shaft mounted transverse to the flow pathand the first roller is fastened to the shaft;

means for resisting movement of the singulator belt about the rollers, shared with the second singulator assembly, the means having a breakaway threshold; and, means for depositing articles on the transport belt upstream of said singulator assemblies; and, a rotatable shaft mounted transverse to the flow path, wherein each first roller is fastened to the shaft;

wherein said means for resisting movement comprises dissimilar diameter first rollers of the two singulators; wherein two singulator assemblies are otherwise substantially similar in geometry; wherein said breakaway threshold is predetermined by the point at which slippage occurs for the belt on the roller of the singulator having the smaller diameter first roller.

14. The apparatus of claim 13, wherein during operation of the apparatus, the belt of each singulator assembly is retarded from moving when an article pass through the singulator nip by the combination of resistive force due to the differing sizes of the first singulator rollers and the fictional force arising from articles pushed against the slope portion of the singulator belt by action of the transport belt.

15. Apparatus for feeding and singulating a stack of flat articles, which comprises:

at least one transport belt, for moving articles downstream along the flow path, wherein the transport belt runs endlessly around rollers, one of which is located downstream of the singulator nip and mounted on a transporter roller shaft;

at least two singulator assemblies, spaced apart transversely to the flow path, each assembly comprising:

a body, having a first end and second end, wherein the first end is pivotably mounted above the flow path;

a first roller mounted on said shaft, at the first end of the body, a second roller, rotatably mounted at the second end of the body;

a singulator belt mounted on and running endlessly around the rollers, wherein a portion of the belt is sloped downwardly toward said transport belt;

means for urging the body pivotably downward toward the transport belt;

wherein, the belt portion at the second roller forms a singulator nip with the transport belt and the belt portion contacts the transport belt when the body pivots downwardly and there is absence of an article in the nip;

means for resisting movement of each singulator belt about respective singulator rollers, the means having a breakaway threshold; and, means for depositing articles on the transport belt upstream of said singulator assemblies; and, takeaway means located downstream of the singulator nip, for pulling articles downstream from the singulator nip at a speed faster than the transport belt moves articles along the flow path, which means comprises a takeaway roller, attached to said transporter roller shaft, having a diameter larger than the outside diameter of the transport belt running around said downstream transporter roller; and, a takeaway idler roller, movably mounted above the takeaway roller, to form therewith a takeaway nip.

16. The method of feeding and singulating a stack of flat articles having varied thickness and shape which comprises:

depositing stacked articles on a transport belt which moves articles along a flow path;

moving the articles along the flow path so that the bottom of the stack becomes shingled and so the leading edges of the articles press against a downwardly sloped portion of an endless singulator belt which forms a singulating nip with the transport belt;

successively feeding articles, one by one, through the singulating nip from the shingled portion of stack, while holding the singulator belt stationary by resisting means which has a breakaway threshold, wherein a small space is created along the flow path, between an article exiting the nip and the following article which is entering the nip; and, contacting the endless singulator belt with the transport belt during the times when there is no article in the singulating nip, whereby, frictional engagement between the belts causes the singulator belt to move by overcoming said breakaway threshold resistance, wherein, the belt is simultaneously scuffed and moved slightly at the point of contacting.

* * * * *